US007926919B2

(12) United States Patent
Kakuda

(10) Patent No.: US 7,926,919 B2
(45) Date of Patent: Apr. 19, 2011

(54) LIQUID DISCHARGING HEAD AND AN IMAGE FORMATION APPARATUS

(75) Inventor: Shinichi Kakuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1101 days.

(21) Appl. No.: 11/520,502

(22) Filed: Sep. 12, 2006

(65) Prior Publication Data

US 2007/0058006 A1 Mar. 15, 2007

(30) Foreign Application Priority Data

Sep. 14, 2005 (JP) ..... 2005-266162

(51) Int. Cl.
*B41J 2/045* (2006.01)

(52) U.S. Cl. ..... 347/71

(58) Field of Classification Search ..... 347/71–72
See application file for complete search history.

(56) References Cited

U.S. PATENT DOCUMENTS

| | | | | |
|---|---|---|---|---|
| 5,381,171 | A | 1/1995 | Hosono et al. | |
| 6,109,728 | A | 8/2000 | Kakuda et al. | |
| 6,331,052 | B1 | 12/2001 | Murai et al. | |
| 7,665,830 | B2 * | 2/2010 | Hashimoto et al. | 347/68 |
| 2003/0067513 | A1 * | 4/2003 | Eguchi et al. | 347/70 |
| 2005/0017601 | A1 * | 1/2005 | Hiyoshi | 310/328 |

FOREIGN PATENT DOCUMENTS

| | | |
|---|---|---|
| JP | 6-188472 | 7/1994 |
| JP | 6-226971 | 8/1994 |
| JP | 2003-211658 | 7/2003 |
| JP | 2004-322505 | 11/2004 |
| JP | 2004-358716 | 12/2004 |

OTHER PUBLICATIONS

Oct. 5, 2010 Japanese official action in connection with counterpart Japanese patent application.

* cited by examiner

*Primary Examiner* — Matthew Luu
*Assistant Examiner* — Lisa M Solomon
(74) *Attorney, Agent, or Firm* — Cooper & Dunham LLP

(57) ABSTRACT

A liquid discharging head and an image formation apparatus are disclosed. The liquid discharging head includes a base member that has a joining surface, to which a piezoelectric device is joined, and a bottom surface. The width of the joining surface in longitudinal directions of a liquid chamber is less than the width of the bottom surface in the longitudinal directions of the liquid chamber; accordingly, the area of the joining surface is less than the area of the bottom surface.

15 Claims, 14 Drawing Sheets

LIQUID DISCHARGING HEAD AND AN IMAGE FORMATION APPARATUS

BACKGROUND

1. Technical Field

This disclosure generally relates to an image formation apparatus including a liquid discharging head, and especially relates to a liquid discharging head wherein a driving element is joined to a base member, and an image formation apparatus therewith.

2. Description of the Related Art

An ink jet recording apparatus is known as an exemplary image formation apparatus of a printer, a facsimile apparatus, a copying apparatus, a multi-function machine, and the like. A recording head of the ink jet recording apparatus uses a liquid discharging head, and recording ("image formation", "imprinting", and "printing", are used as synonyms) is carried out on a recording medium such as recording paper. Although the recording medium may be called recording paper below, it is not limited to paper, but includes a recording medium, imprint paper, an imprint material, and a recording object. Recording is carried out by discharging an ink drop serving as recording liquid.

Examples of the liquid discharging head include an ink jet head, wherein pressure for pressurizing the liquid, i.e., the ink, contained in a liquid chamber is generated by a piezoelectric body. The piezo-electric body is often made of layers of internal electrodes and piezo-electric layers that are alternately arranged. Further, a wall surface of the liquid chamber is a diaphragm that is capable of elastic deformation, and is displaced in one of d33 and d31 directions by the piezoelectric body. The displacement causes a change in volume, and therefore, pressure in the liquid chamber; and an ink drop is discharged.

[Patent Reference 1] JPA 2003-211658

[Patent Reference 2] JPA 2004-322505

According to a conventional liquid discharging head as disclosed by Patent References 1, and 2, the width of a supporting substrate (base member) that is joined to a piezoelectric device is made less than the width of a piezoelectric vibrator.

Here, the conventional liquid discharging head as disclosed by Patent Reference 1 is described with reference to FIG. 16 and FIG. 17.

The conventional liquid discharging head includes a passage plate 501 made of, e.g., a silicon substrate, forming two or more through-bores and independent liquid chambers serving as ink passages, a nozzle plate 502 formed on the upper surface of the passage plate 501, having two or more discharging nozzles formed by, e.g., nickel electrocasting, and a diaphragm 503 formed on the undersurface of the passage plate 501 formed by, e.g., nickel electrocasting. The three items above constitute the ink passage.

Further, an actuator unit is formed on the undersurface of the diaphragm 503, the actuator unit including a laminated type piezoelectric device 505 arranged in two columns on a base member 504 made of metal. On the outside of the piezoelectric device 505, a common ink passage 507 is formed by a frame member 506 that is joined to the diaphragm 503 such that the ink is supplied to each liquid chamber.

According to this liquid discharging head, a driving voltage is applied to the piezoelectric device 505, then a displacement occurs in the laminating direction of the piezoelectric device 505 (i.e., the vertical direction in the drawing), and the diaphragm 503 moves toward each of the liquid chambers, reducing the capacity of the liquid chambers, and causing the pressure inside the liquid chambers to rise. Accordingly, ink drops are discharged from the discharging holes (nozzles) of the nozzle plate 502 through a free passage.

As for the liquid discharging head using the driving element like the piezoelectric device, the driving element (piezoelectric device) that determines properties of the head accounts for a major portion of cost. In particular, the laminated type piezoelectric device is expensive; for this reason, the size of the piezoelectric device is desired to be as small as possible while maintaining the printing properties of the head.

The miniaturization of the driving element leads to miniaturization of the base member that is joined to the driving element. On the other hand, the height of the head cannot be made too small in consideration of arranging a roller for pressing down a recording medium at a portion near the head as much as possible when conveying the recording medium, and in consideration of obtaining capacity of a common liquid chamber 507 for supplying the recording liquid to the liquid chamber.

Consequently, the base member must have a high aspect ratio, i.e., small width and great height.

When, in general, using a laminated type piezoelectric device, after joining a piezoelectric device to a base member, the piezoelectric device is divided into individual driving elements (piezoelectric devices) by a slot process using a dicing saw or a wire saw.

In this case, when dividing the piezoelectric device into individual elements, the base member vibrates due to the stress generated in the piezoelectric device, and an individual piezoelectric device often falls over. The greater is the aspect ratio of the base member, the greater is the vibration caused by the stress. This remarkably degrades the yield when processing the piezoelectric device.

Specifically, with reference to FIG. 16 and FIG. 17, if the piezoelectric device 505 is miniaturized, the base member 504 is miniaturized, that is, its width D is decreased. On the other hand, the common liquid chamber 507 formed by the frame member 506 cannot be made too small because it has to provide sufficient liquid capacity, and in consideration of damping of the liquid vibration when printing. Since the height H of the actuator unit and the height H of the frame member 506 have to agree, the height H of the actuator unit cannot be decreased, which increases the aspect ratio of the base member 504. The great aspect ratio of the actuator unit causes the piezoelectric device 505 to vibrate due to the stress generated when dividing the piezoelectric device 505 into individual elements, which leads to falling over of an individual piezoelectric element, and exfoliation of an internal electrode.

SUMMARY

In an aspect of this disclosure, there is provided a liquid discharging head that is miniaturized, withstands stress and vibration when a driving element is being processed, and has a high yield; and there is also provided an image formation apparatus including the liquid discharging head.

In a preferred embodiment of this disclosure, there is provided a liquid discharging head wherein an area of a first surface (joining surface) of a base member is less than an area of a second surface (bottom surface) that is opposite to the first surface of the base member, and driving elements are joined to the base member through the first surface.

Here, it is desirable that the driving elements be laminated type piezoelectric devices. Further, the base member is desired to have a step form (as shown by 13 in FIG. 7) as viewed in a plane that perpendicularly intersects directions of a nozzle sequence. ("Directions of the nozzle sequence" are longitudinal directions of the base member.) Alternatively, the base member is desired to have an inclined cut (as shown by 13 in FIG. 9) in the above-described plane. Further alternatively, the base member is desired to have an "I" shape (as shown by 13 in FIG. 10) in the same plane.

Further, the area of the first surface of the base member, which surface contacts the driving element, is desired to be less than the area of a bottom surface contour of the driving element, a part of the bottom surface contour of the driving element contacting the first surface of the base member. Further, it is desirable that a flexible printed circuit board be directly and electrically connected to edge electrodes of the piezoelectric devices. Further, it is desired that at least one of surfaces of the base member in directions of a nozzle sequence and at least one of edge surfaces of the piezoelectric devices share the same plane (refer to FIG. 12). Further, it is desirable that a "side shooter" method be employed wherein the drop discharging direction differs from the direction of flow of recording liquid in the liquid chamber.

In the aforementioned embodiment, there is further provided an image formation apparatus that includes the liquid discharging head.

With the aforementioned liquid discharging head, stress and vibration are reduced when performing a dividing process of the driving elements joined to the base member, and productivity is improved, even if the driving elements are miniaturized. This is realized by making the area of the first surface of the base member less than the second surface that is opposite to the first surface, and joining the driving elements to the base member through the first surface.

The aforementioned image formation apparatus includes said liquid discharging head; for this reason, miniaturization and cost reduction are attained.

DESCRIPTION OF THE PREFERRED EMBODIMENTS

Figure 1:
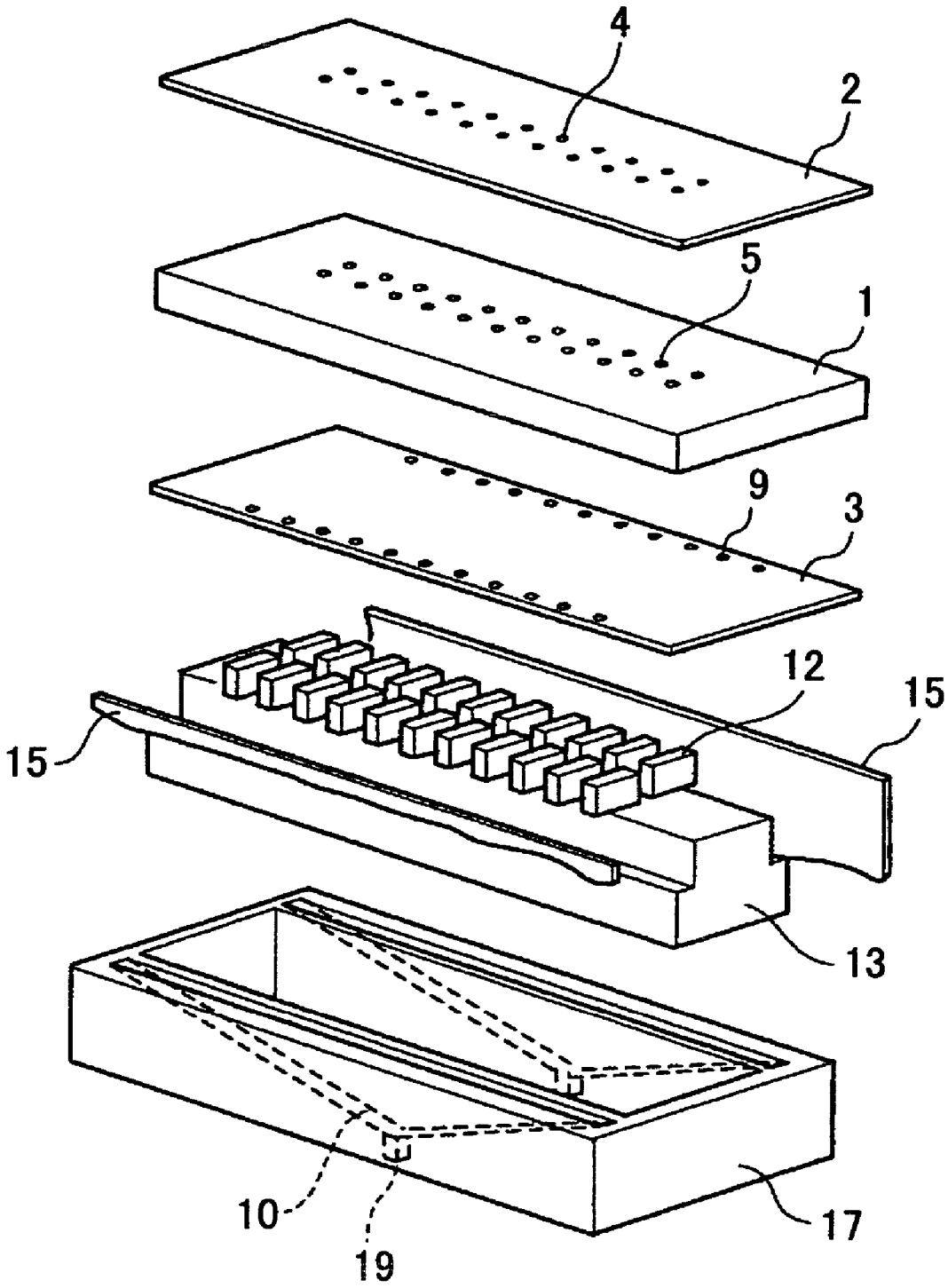
FIG. 1 is an exploded perspective diagram of a liquid discharging head according to the first embodiment of the present invention.
Figure 2:
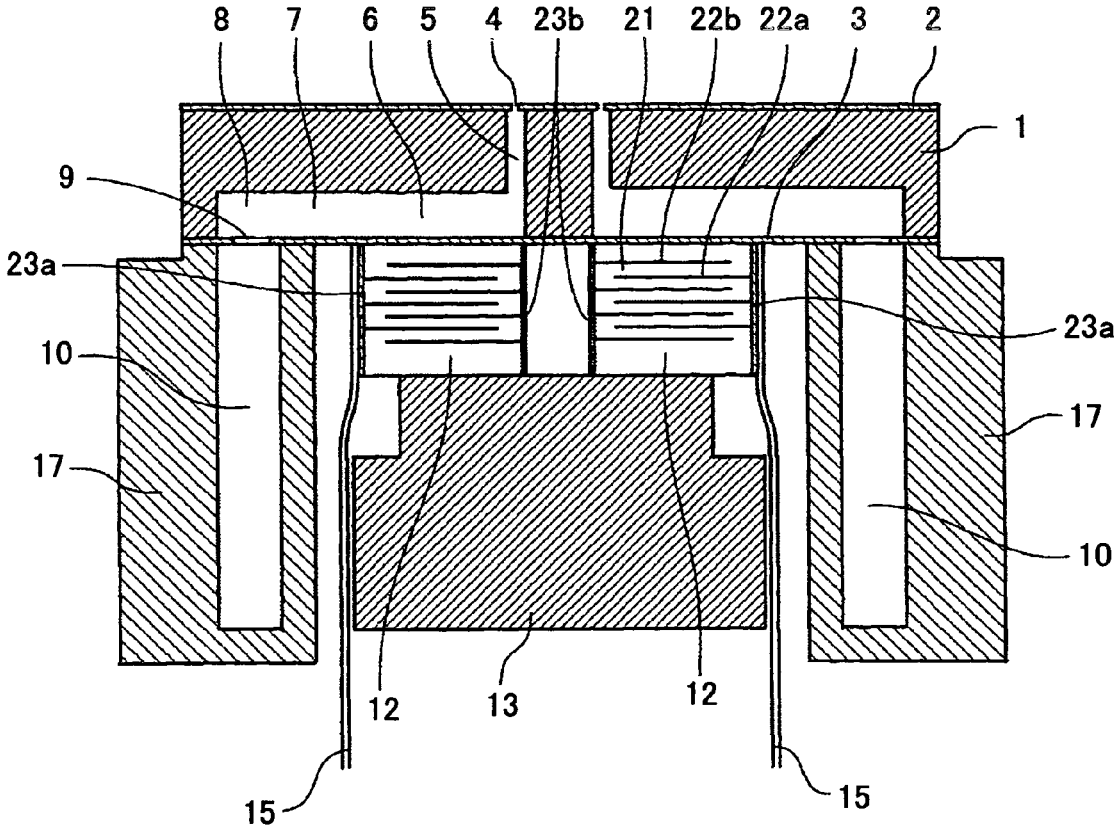
FIG. 2 is a cross-sectional diagram of the liquid discharging head along longitudinal directions of a liquid chamber.

In the following, embodiments of the present invention are described with reference to the accompanying drawings. A liquid discharging head according to the first embodiment of the present invention is described with reference to FIG. 1 through FIG. 4.

The liquid discharging head includes a passage plate 1 formed by, e.g., a single-crystal silicon substrate, a nozzle plate 2 serving as a nozzle forming member joined to the upper surface of the passage plate 1, a diaphragm 3 joined to the undersurface of the passage plate 1, nozzles 4 for discharging drops, free passage ways 5, a liquid pressurizing chambers 6, fluid resistance sections 7, and free passage sections 8 having corresponding passages to the liquid pressurizing chambers 6 via the corresponding fluid resistance sections 7. Recording liquid (for example, ink) is stored in a common liquid chamber 10 formed in a frame member 17, and is supplied to the free passage sections 8 through corresponding supply mouths 9 formed in the diaphragm 3.

On a side of the diaphragm 3 opposite to the side of the liquid pressurizing chambers 6, an upper surface of corresponding laminated type piezoelectric devices 12 serving as driving elements (actuator units, pressure generating units) is joined corresponding to each liquid pressurizing chamber 6 through a connection section (not illustrated) formed at the diaphragm 3. Here, the diaphragm 3 serves as a wall of the liquid pressurizing chambers 6. Further, lower surfaces of the laminated type piezoelectric devices 12 are joined to a base member 13.

Each of the piezoelectric devices 12 includes a piezoelectric layer 21, into which internal electrodes 22*a* and 22*b* are alternately laminated. The internal electrodes 22*a* and 22*b* are pulled out to corresponding edges and connected to edge electrodes (external electrodes) 23*a* and 23*b*, respectively. By applying a voltage between the edge electrodes 23*a* and 23*b*, displacement in directions of the lamination is produced.

In order to supply a driving signal to the piezoelectric devices 12, a FPC cable 15 is connected to the piezoelectric devices 12 by such as a solder junction, ACF (anisotropic conductive film) junction, and wire bonding. A driving circuit (driving IC) that is not illustrated for selectively supplying a driving wave to each piezoelectric devices 12 is mounted on the FPC cable 15.

Figure 3:
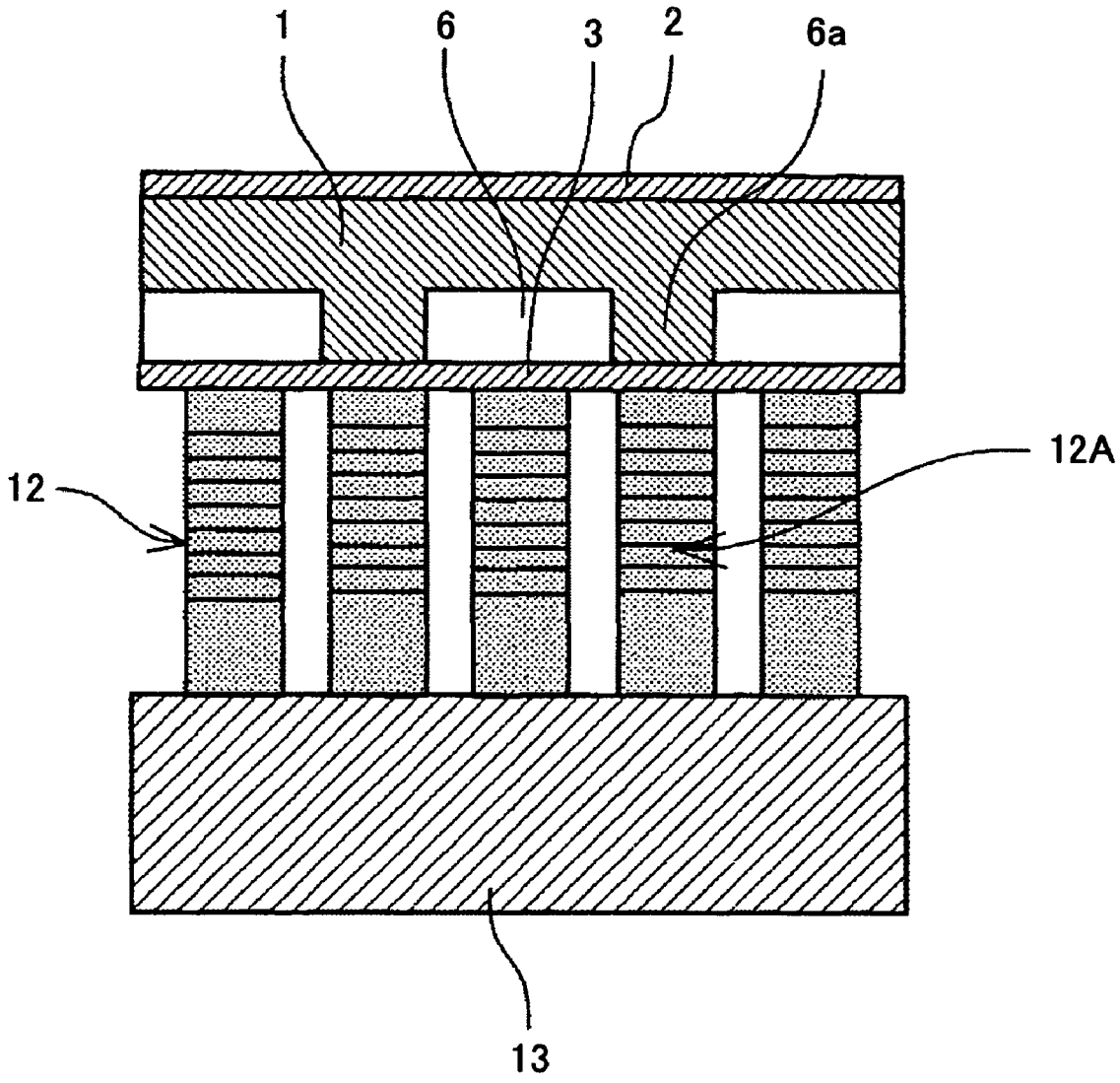
FIG. 3 is a cross-sectional diagram of a bi-pitch structure of the liquid discharging head in latitudinal directions of the liquid chamber.
Figure 4:
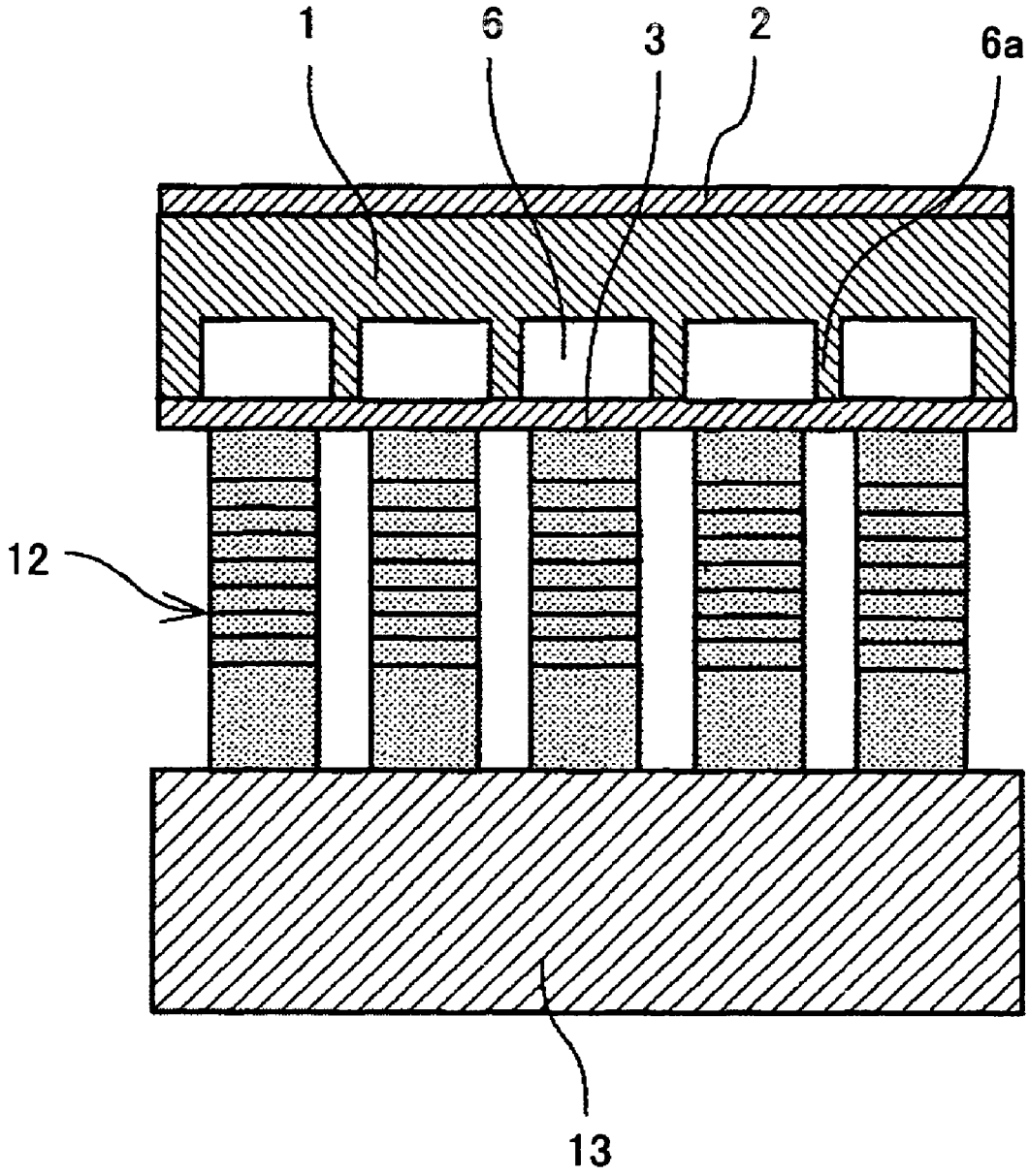
FIG. 4 is a cross-sectional diagram of a normal-pitch structure of the liquid discharging head in latitudinal directions of the liquid chamber.

Here, in the latitudinal directions of the liquid chambers 6, the structure can be such that the piezoelectric devices 12 and support sections 12A are alternately arranged as shown in FIG. 3, which is a bi-pitch structure. Alternatively, the structure can be such that no support section 12A is formed as shown in FIG. 4, which is a normal pitch structure.

According to the liquid discharging head of the embodiment, the ink in the liquid pressurizing chambers 6 is pressurized by the displacement of the piezoelectric devices 12 in a d33 direction, and an ink drop is discharged by the side shooter method wherein the ink drop discharging direction differs from the direction of the flow of the recording liquid in the liquid pressurizing chambers 6. By using the side shooter method, the size of the piezoelectric devices 12 becomes almost the size of the liquid discharging head. That is, miniaturization of the piezoelectric devices 12 directly miniaturizes the liquid discharging head, facilitating the miniaturization of the liquid discharging head.

Further, a frame member 17 is joined to the outside of the actuator unit that includes the piezoelectric devices 12, the base member 13, and the FPC 15. Here, the frame member 17 is made by injection molding of such as epoxy system resin and polyphenylene sulphite. The frame member 17 forms the common liquid chamber 10 as described above. The frame member 17 has the supply mouths 19 that are connected to an external liquid source such as a sub tank and a recording liquid cartridge (not illustrated) for supplying recording liquid to the common liquid chamber 10 from the external liquid source.

Here, the passage plate 1 is made of a single-crystal silicon substrate having a crystal-face direction (orientation) (110); the passage plate 1 is anisotropically etched using alkaline etching liquid such as potassium-hydroxide solution (KOH) so that the free passage way 5, penetration holes to serve as the liquid pressurizing chambers 6, the fluid resistance sections 7, and the free passage sections 8 are formed. In addition, the pressurization liquid pressurizing chambers 6 are separated by partitions 6*a*.

The nozzle plate 2 is made of a nickel plate, and is manufactured by an electro forming method (electro-casting). The nozzles 4 are formed in the nozzle plate 2 corresponding to each liquid pressurization chamber 6, each nozzle 4 having a diameter between 10 and 35 μm. The nozzle plate 2 is joined to the passage plate 1 with adhesives. A surface of the nozzle plate 2 has a water-repellent layer formed by silicone resin, etc. This surface is on the drop discharging side; in other words, this surface is the one opposite to the liquid pressurizing chambers 6.

The diaphragm 3 is made of a metal plate of nickel, and is manufactured by the electro forming method (electro-casting). The diaphragm 3 has thin portions corresponding to the pressurization liquid pressurizing chambers 6 so that deformation is facilitated, and has the connection section (not illustrated) at the central part for joining to the piezoelectric devices 12.

A solid piezoelectric device is joined to the base member 13, and a dividing process (slot making process) using a dicing saw and the like is carried out so that the solid piezoelectric device is divided into sections, namely, the piezoelectric devices 12. The support sections 12A in the case of the bi-pitch structure as shown in FIG. 3 are ones of such divided sections, namely, the piezoelectric devices 12; however, since no driving voltage is applied, they merely serve as the support sections.

The liquid discharging head structured as described above is driven by various methods. One of the methods is "push discharging", wherein a control unit (not illustrated) applies a driving pulse voltage between 20 and 50 V to appropriate piezoelectric devices 12 according to an image to be recorded. The driving pulse voltage causes displacements of the piezoelectric devices 12, deforms (pushes) the diaphragm 3 toward the nozzle plate 2, and a drop is discharged from the corresponding nozzles 4 of the nozzle plate 2 by pressurizing the liquid in the liquid pressurizing chambers 6 by capacity (volume) change of the liquid pressurizing chambers 6. Then, the pressure in the liquid pressurizing chambers 6 declines because of discharging of the drop, and some negative pressure is generated in the liquid pressurizing chambers 6 because of the inertia of the liquid flow. Then, the voltage is turned off, and the diaphragm 3 returns to the original position, and the liquid pressurizing chambers 6 takes the original form. This produces additional negative pressure. At this time, the liquid pressurizing chambers 6 is filled up with recording liquid supplied from the common liquid chamber 10, and is ready for a next drop to be discharged from the nozzles 4 according to the following driving pulse.

Another discharging method of the liquid discharging head is "pull and release discharging", wherein the diaphragm 3 is first pulled, and then released. Further another discharging method is "pull and push discharging", wherein the diaphragm 3 is first pulled, and then positively pushed.

Figure 5:
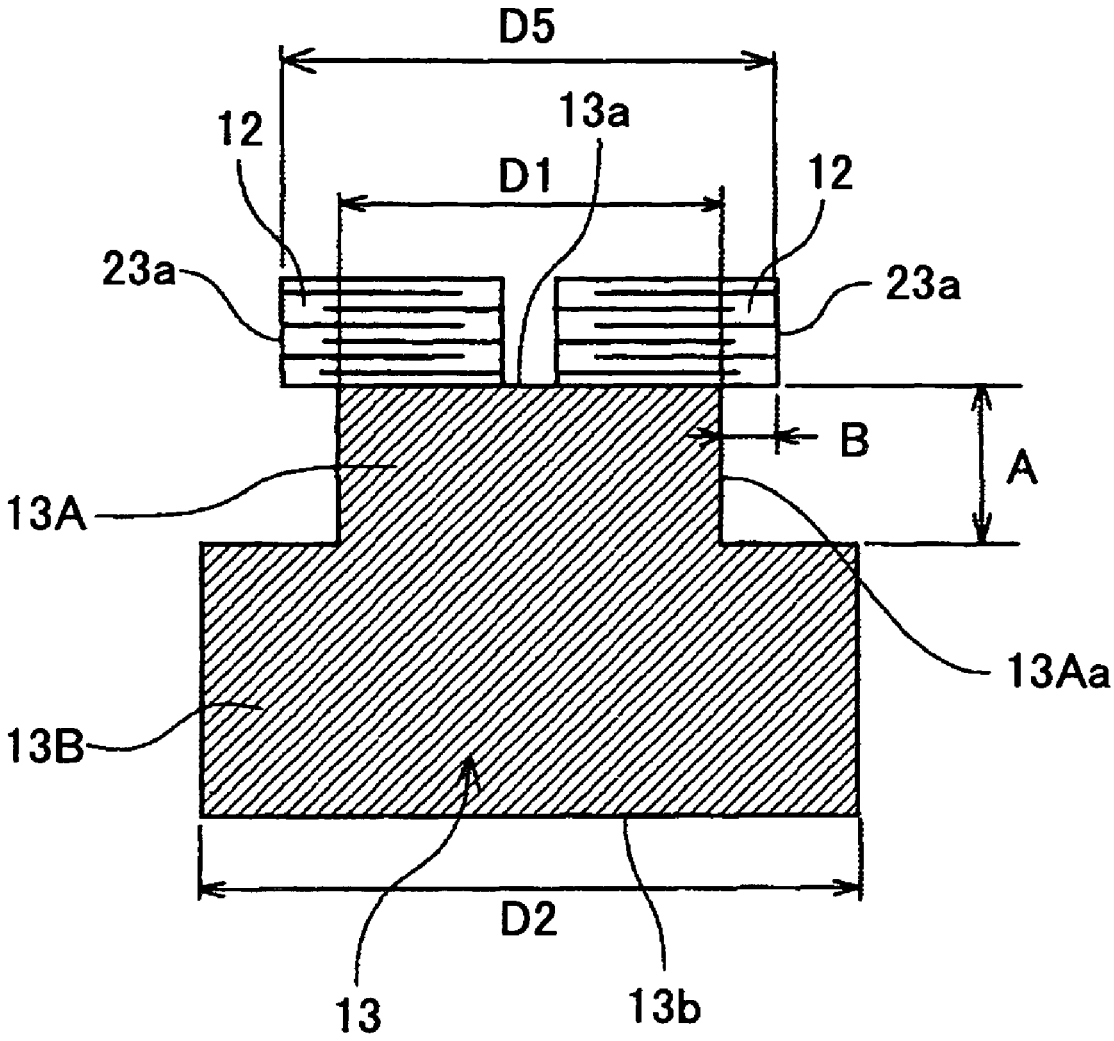
FIG. 5 is a cross-sectional diagram of an actuator unit of the liquid discharging head.

Next, the actuator unit of the liquid discharging head is described with additional reference to FIG. 5.

Here, the base member 13 is shaped like a reversed "T", and contacts the piezoelectric devices 12 at a joining surface 13*a*. A width D1 of the joining surface 13*a* in longitudinal directions of the liquid chamber is less than a width D2 of a bottom surface 13*b* of the base member 13. In this way, the area of the joining surface 13*a* is less than the area of the bottom surface 13*b*. Here, the longitudinal directions of the liquid chambers are directions that perpendicularly intersect the directions of the nozzle sequence. ("Directions of the nozzle sequence" are longitudinal directions of the base member.)

Specifically, the joining surface 13*a* of the base member 13, which is the joining surface for the piezoelectric devices 12, is cut out at both ends in the longitudinal directions of the liquid chamber such that it is shaped like a stair (reversed "T") in a plane (or cross-sectional plane) that perpendicularly intersects the direction of the nozzle sequence. That is, the base member 13 has a smaller width section 13A that includes the joining surface 13*a* that joins the piezoelectric devices 12, and a greater width section 13B that includes the bottom surface 13*b*.

By arranging the bottom surface 13*b* to be greater than the joining surface 13*a*, the aspect ratio of the base member 13 is reduced. In this way, vibration is reduced and a stable operation is possible when the dividing process of dividing the solid piezoelectric device into sections is carried out.

Figure 6:
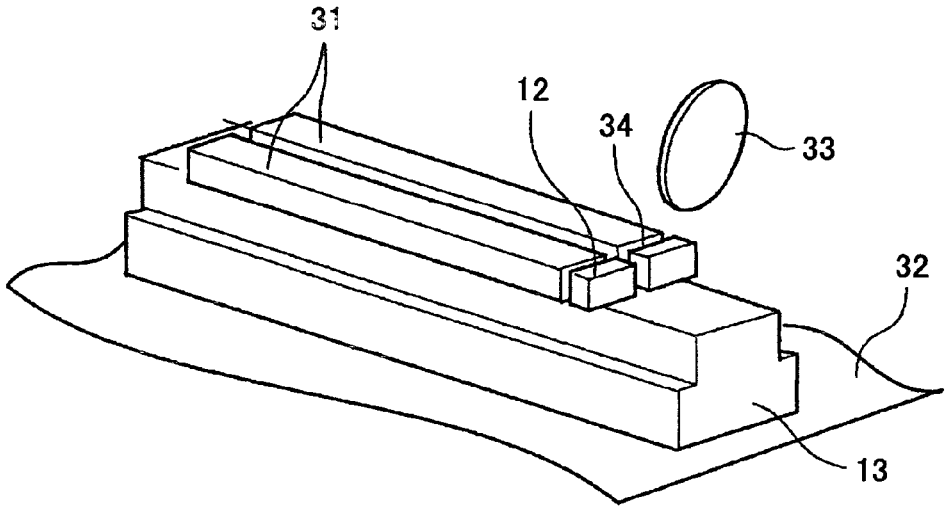
FIG. 6 is a perspective diagram for describing a dividing process of the actuator unit.

For example, as shown in FIG. 6, laminated type piezoelectric device members 31 (solid piezoelectric devices) are adhered to the top of the base member 13 that is fixed onto the top of a dicing base 32. Then, the laminated type piezoelectric device members 31 are divided into sections by slots 34 with a blade 33 of a dicing saw; each of the sections serves as a piezoelectric device 12. (Here, the laminating type piezoelectric device member 13 does not have to be completely sliced, but a half cut, leaving a part on the side of the base member 31, is acceptable.) At this time, even if the width (width in the longitudinal directions of the liquid chamber) of the piezoelectric device member 31 becomes small, since the base member 13 has a relatively great area at the bottom surface 13*b*, the base member 13 is sufficiently fixed to the dicing base 32. Accordingly, when dividing the piezoelectric device member 31, stress and vibration applied to the piezoelectric device member 31 are decreased. Accordingly, falling off of the divided piezoelectric devices 12, and exfoliation of the internal electrodes 22*a* and 22*b* are reduced.

Figure 7:
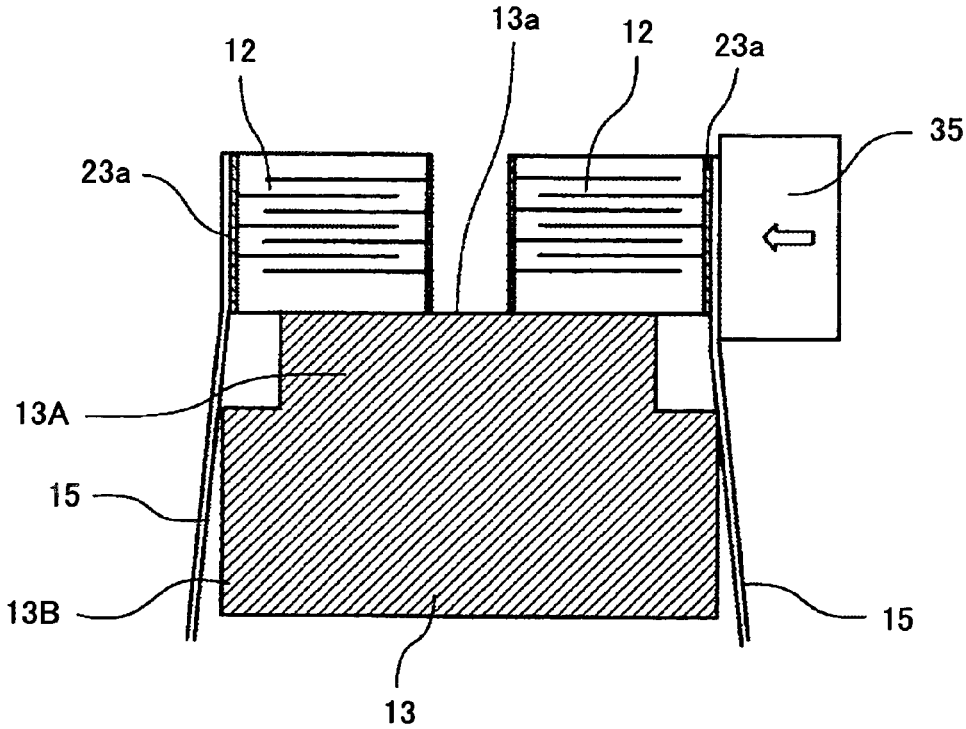
FIG. 7 is a cross-sectional diagram for describing a FPC connection process of the actuator unit.

Further, as described above, in order to improve assembly workability and reliability of the actuator unit, it is desirable that the FPC 15 be directly and electrically connected to the edge electrodes 23*a* of the piezoelectric devices 12. In this case, as shown in FIG. 7, a heater chip 35 is pressed to the FPC 15 so that the FPC 15 and the edge electrodes 23*a* of the piezoelectric devices 12 are electrically connected by soldering.

In this case, if the joining surface 13*a* of the base member 13 is wider (in the longitudinal directions of the liquid chamber) than the piezoelectric devices 12, the heater chip 35 contacts the edge of the base member 13, and sufficient pressure may not be applied to the piezoelectric devices 12. Even if the contact is avoided, and only the piezoelectric devices 12 are heated, the heat is transferred to the base member 13. This degrades the reliability of the electrical connection.

Accordingly, it is desired that the edge of the base member 13 be recessed from the edge electrodes 23*a* of the piezoelectric devices 12 by a distance B, and a height A of the recessed portion of the base member 13 be 0.5 mm or greater. If the height A of is less than 0.5 mm, the heat of the heater chip 35 is transferred to the base member 13 and sufficient heating cannot be obtained.

As described, the base member 13 and the piezoelectric devices 12 are joined at the joining surface 13*a* of the smaller width section 13A, and the edge electrodes 23*a* of the piezoelectric devices 12 are projected with reference to an edge 13Aa (FIG. 5); the smaller width section 13A has the height A. In this way, the reliability of the electrical connection between the FPC 15 and the edge electrodes 23*a* of the piezoelectric devices 12 is improved.

By arranging the width D1 to be less than the width D2, where D1 is the width of the joining surface of the base member, at which joining surface the piezoelectric devices is joined (the width in the directions perpendicularly intersecting the nozzle sequence, i.e., the width in the longitudinal directions of the liquid chamber), and D2 is the width of the bottom surface, the stress and the vibration at the time of processing are reduced, thereby improving the reliability of the electrical connection.

Figure 8:
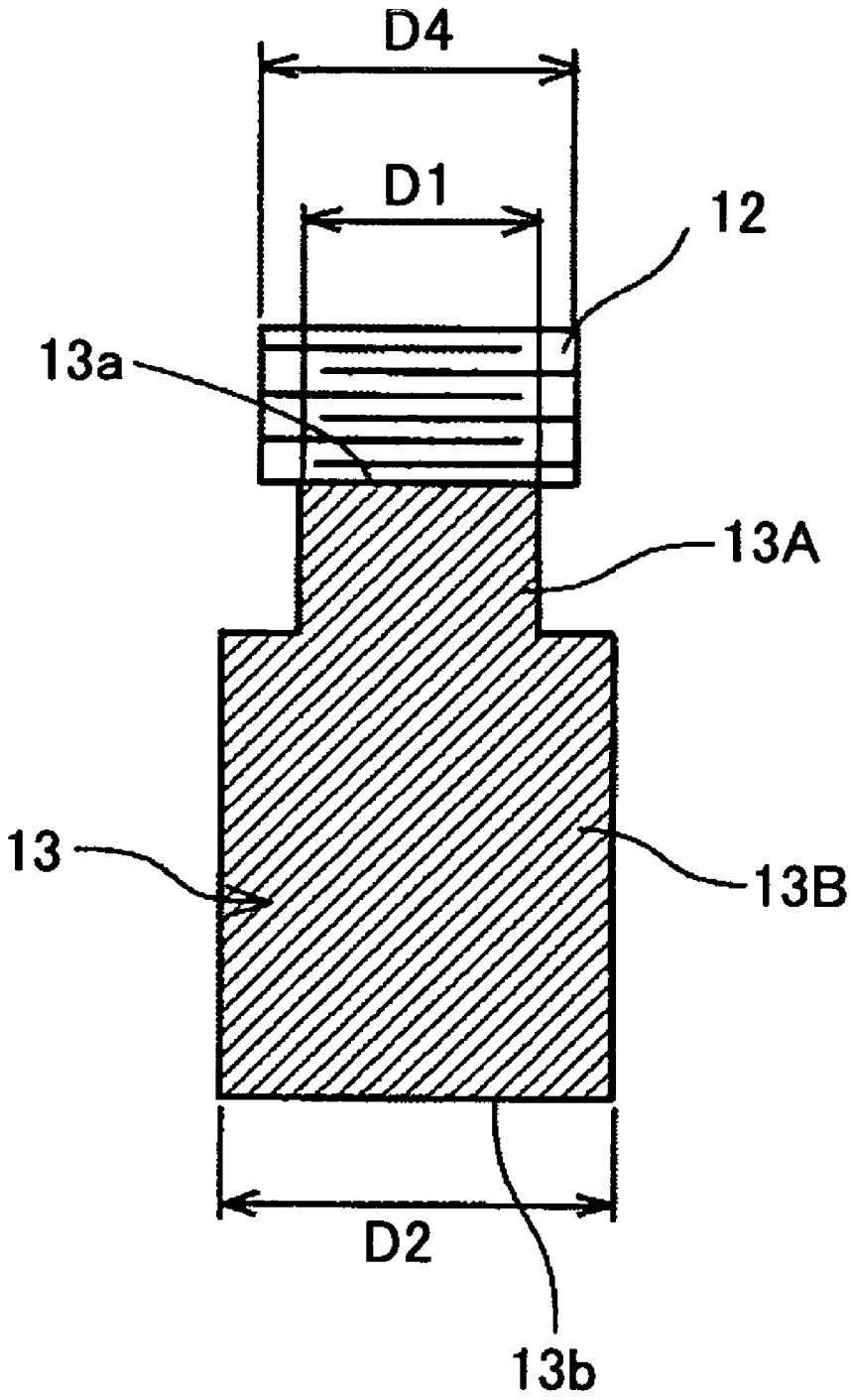
FIG. 8 is a cross-sectional diagram showing another example of the actuator unit.

In the above, an example of providing two sequences of the piezoelectric devices 12 to the base member 13 has been described. Nevertheless, the structure may be such that only one sequence of the piezoelectric devices 12 is provided as shown in FIG. 8. Further, the base member 13 may be a single solid body, or alternatively may be made of two or more layered members. Further, the displacement of the piezoelectric device may be in the directions of lamination, or alternatively, perpendicular thereto.

In the following, the base member 13 applicable to the second and subsequent embodiments of the liquid discharging head of the present invention is described with reference to FIG. 9 and subsequent drawings.

Figure 9:
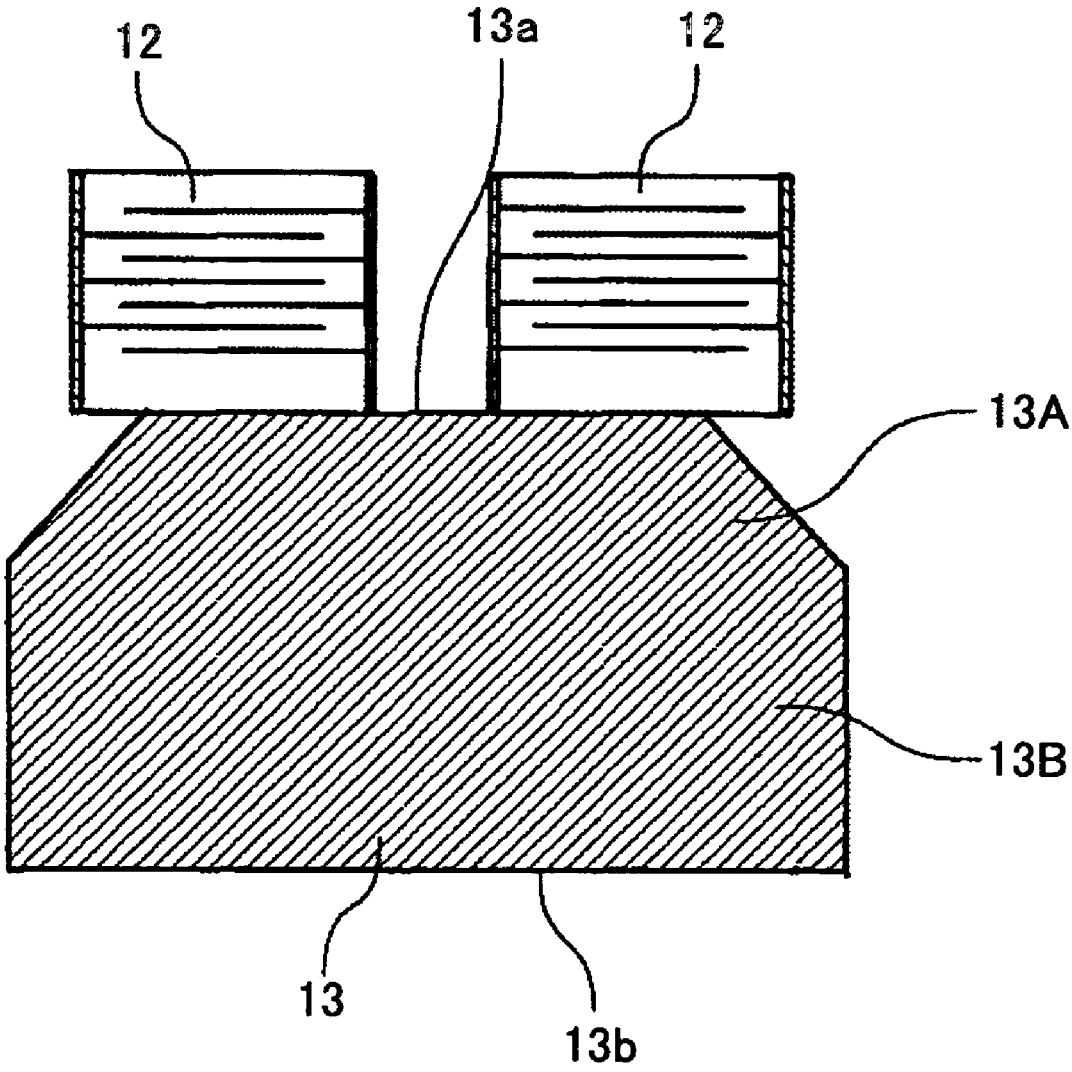
FIG. 9 is a cross-sectional diagram of the actuator unit of the liquid discharging head according to the second embodiment of the present invention.

The base member 13 of the second embodiment is shown in FIG. 9, wherein the base member 13 has slanted cutoffs, i.e., chamfered with an angle at the ends of the joining surface 13*a* that touches the piezoelectric devices 12. That is, the base member is cut aslant in a plane perpendicularly intersecting the directions of the nozzle sequence. With this shape of the base member 13, the same effect as described above can be obtained.

Figure 10:
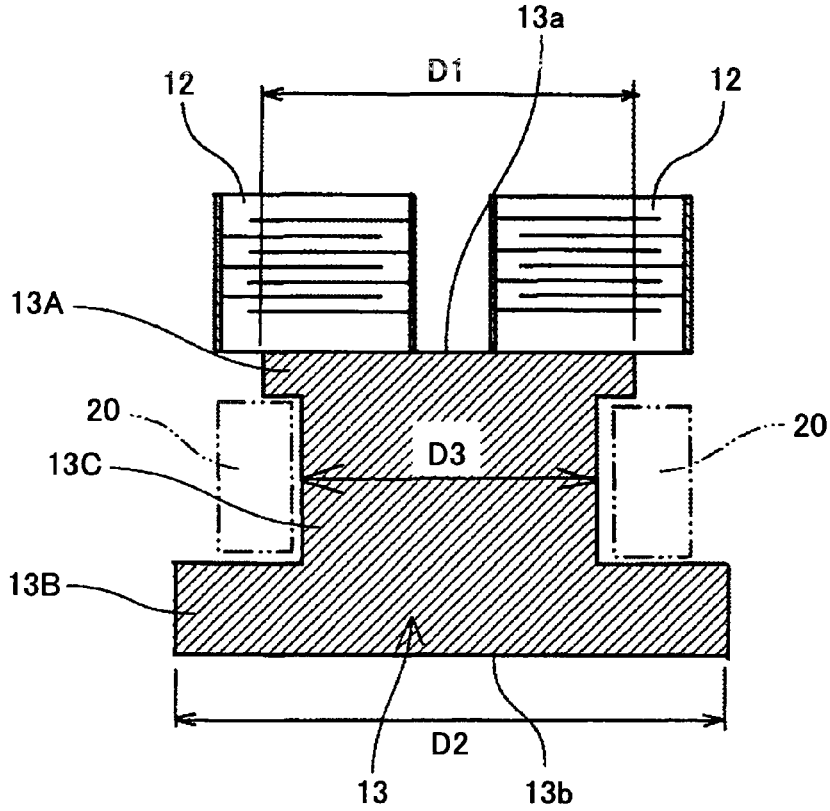
FIG. 10 is a cross-sectional diagram of the actuator unit of the liquid discharging head according to the third embodiment of the present invention.
Figure 11:
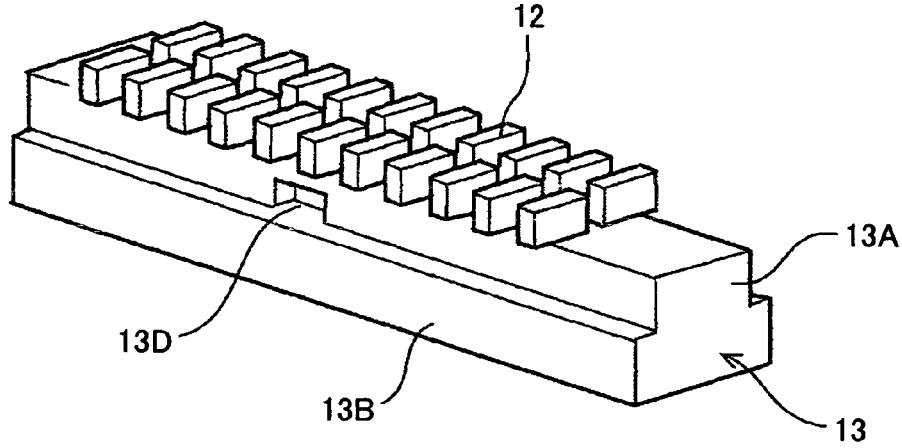
FIG. 11 is a perspective diagram showing another example of the third embodiment.

The base member 13 of the third embodiment is shown in FIG. 10, wherein the base member 13 has a smallest width section 13C, having a width D3, between the smaller width section 13A that includes the joining surface 13*a*, having the width D1 and the greater width section 13B, having the width D2. In other words, the cross-section of the base member 13 in a plane perpendicularly intersecting the direction of the nozzle sequence (i.e., the plane of the drawing) is shaped like a cross-section of a rail, or a letter "I". In this way, there are spaces available on the outside of the smallest width section 13C. For example, a driver IC 20 mounted on the FPC 15 can be accommodated in the space. Here, although the smallest width section 13C is arranged throughout the length of the base member 13 in the directions of the nozzle sequence, if it is only for mounting the driver IC 20, a dip section 13D as shown in FIG. 11 may serve the purpose.

Figure 12:
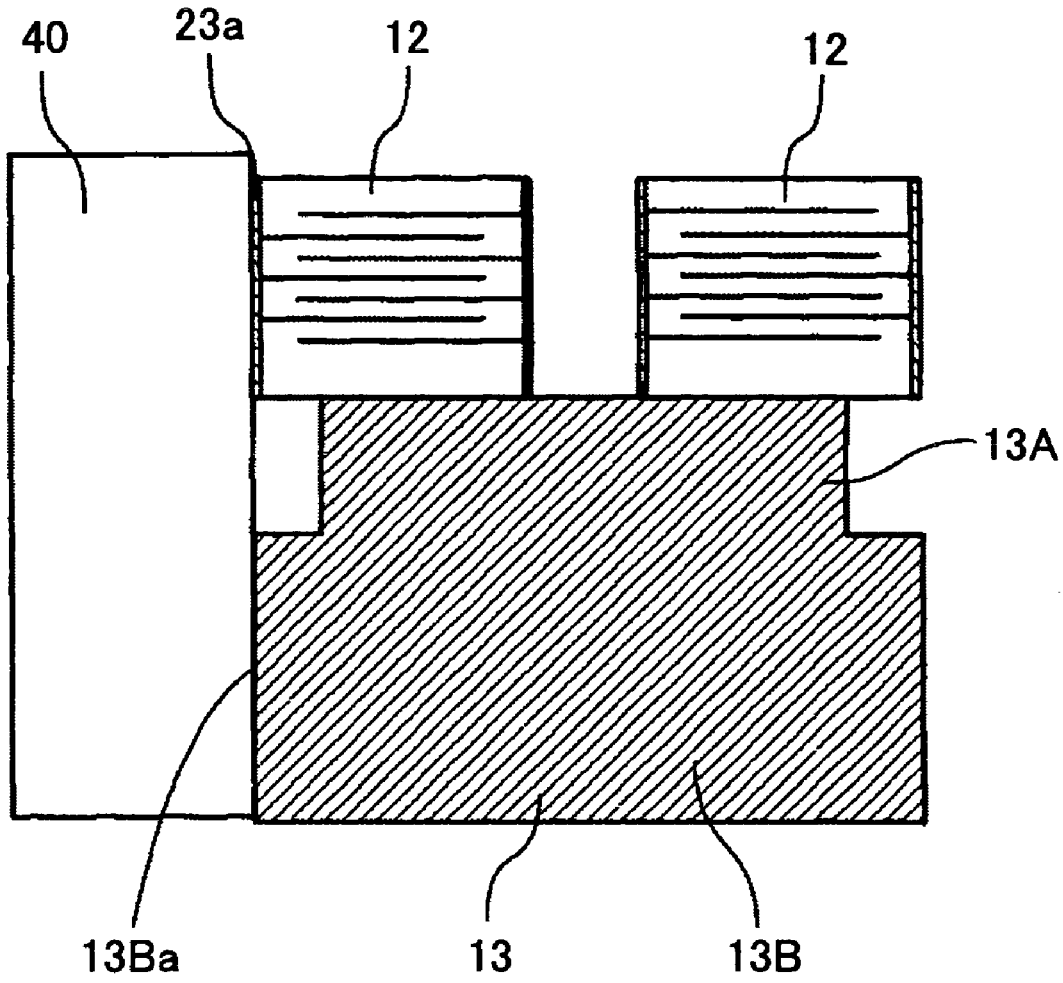
FIG. 12 is a cross-sectional diagram of the actuator unit of the liquid discharging head according to the fourth embodiment of the present invention.

According to the base member 13 of the fourth embodiment shown in FIG. 12, an edge surface 13Ba of the greater width section 13B and an edge (here, the external surface of the edge electrode 23*a*) of the piezoelectric devices 12 are in the same plane, so that the edge surface 13Ba perpendicularly intersects the direction of the nozzle sequence.

That is, when joining the base member 13 and the piezoelectric device member 31, using the width D2 as arrangement criteria of the piezoelectric devices 12, where the width D2 is of the greater width section 13B having the bottom surface 13*b* of the base member 13, the edge surface 13Ba of the greater width section 13B of the base member 13 and the piezoelectric device member 31 are made to touch a reference member 40 such that positioning of the piezoelectric device member 31 is easily carried out, and the productivity is raised.

According to the embodiments described above, the width D1 of the joining surface of the base member is made less than the width of the driving element (piezoelectric device). Examples of the width of the driving element (piezoelectric device) include D4 in FIG. 8 where only one sequence of driving elements is present, and D5 in FIG. 5 where more than one sequence of driving elements are present. In this way, the direct electrical connection of, for example, the FPC is reliably carried out.

Figure 13:
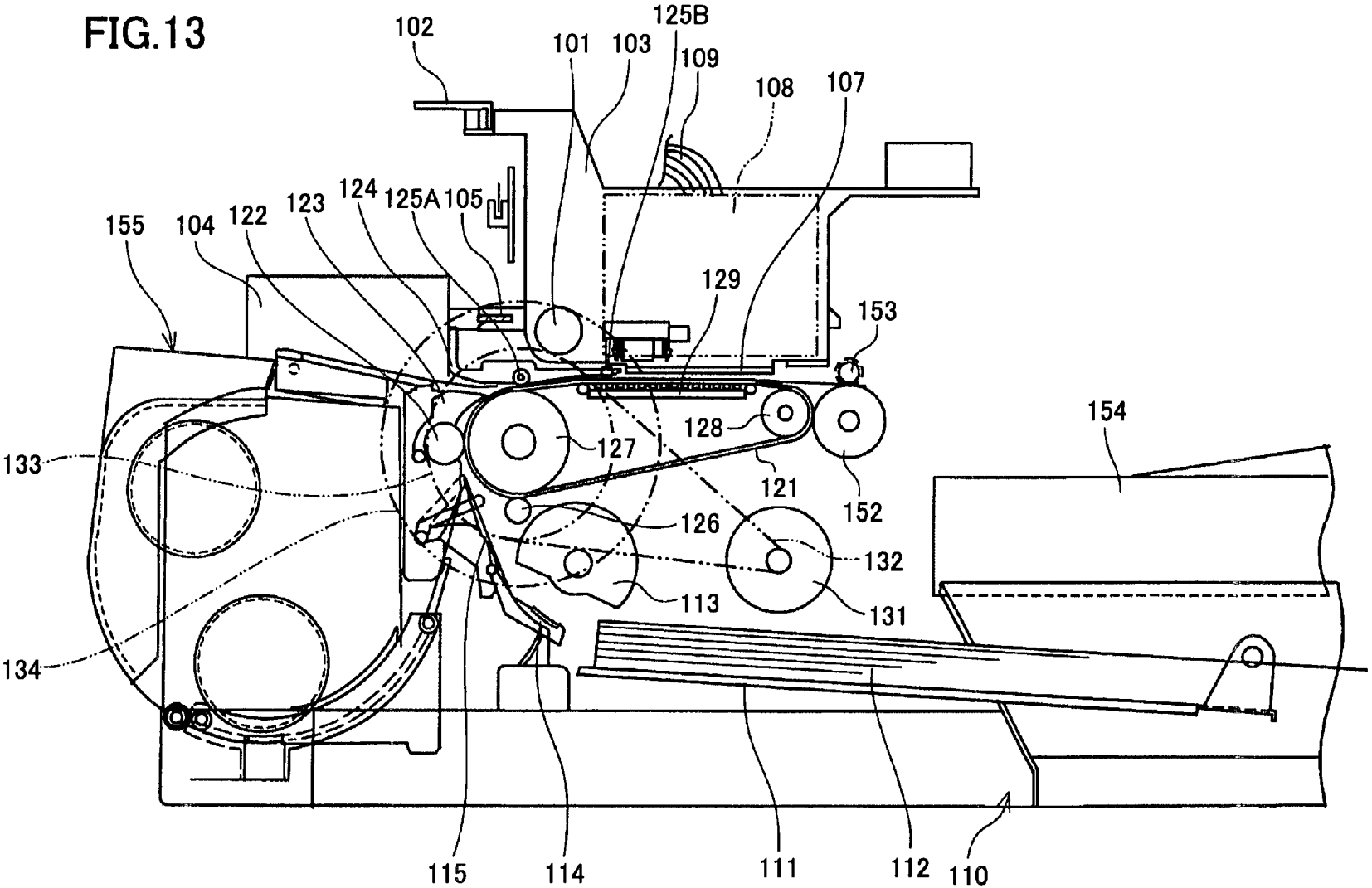
FIG. 13 is a cutaway view of an example of an image formation apparatus according to the embodiment of the present invention.
Figure 14:
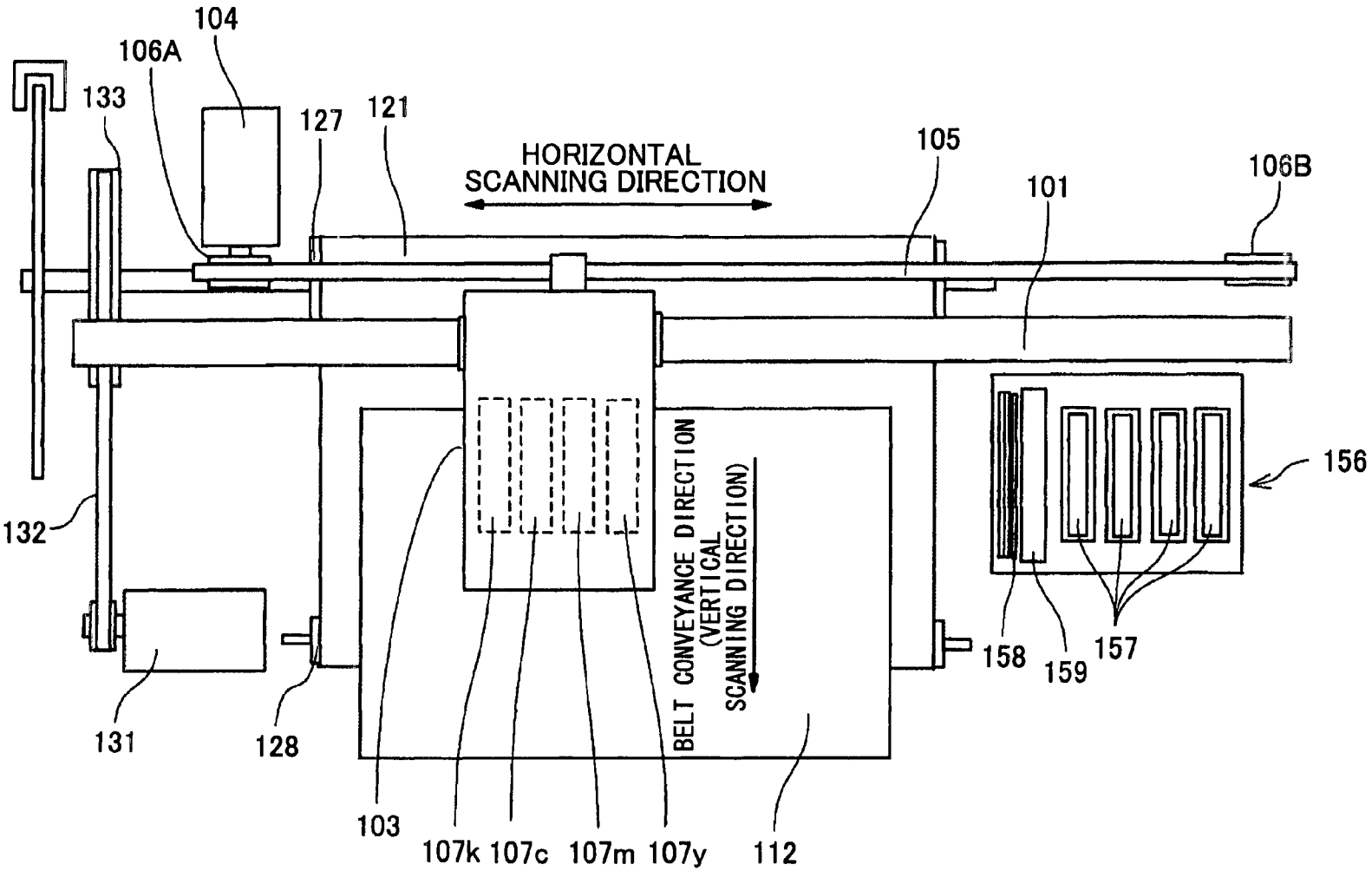
FIG. 14 is a plan view of the main part of the image formation apparatus.

Next, an example of an image formation apparatus using the liquid discharging head of the present invention is described with reference to FIG. 13 and FIG. 14. Here, FIG. 13 is a lateral cutaway view of the image formation apparatus, and FIG. 14 is a plan diagram showing the main part of the image formation apparatus.

The image formation apparatus includes a guide rod 101 and a guide rail 102 that are horizontally fixed to side plates (not illustrated), both serving as a guide member, a carriage 103 that slideably moves in directions of horizontal scanning (shown by an arrow in FIG. 14), and a horizontal scanning motor 104 that drives the carriage 103 through a timing belt 105 that is wound around a drive pulley 106A and a follower pulley 106B.

A recording head 107 is mounted on the carriage 103, and the recording head 107 includes liquid discharging heads 107*k*, 107*c*, 107*m*, and 107*y* for discharging a drop (ink drop) in each color of black (K), cyan (C), magenta (M), and yellow (Y), respectively. The liquid discharging heads are according to the embodiments of the present invention, and are arranged along the directions of horizontal scanning. A direction of drop discharging is downward. Here, although the recording head 107 is constituted by the independent liquid discharging heads, it can be constituted by one or more heads that have nozzle sequences capable of discharging drops in different colors. Further, the number of the colors and the array sequence of the colors are not restricted to those described above.

The recording head 107 mounted on the carriage 103 includes a sub tank 108 for supplying ink in each color. The inks are supplemented through an ink supply tube 109 to the sub tank 108 from a main tank (an ink cartridge) that is not illustrated.

The image formation apparatus further includes a feed section for feeding a recording medium 112 (paper, form) arranged on a form loading section (pressure plate) 111 such as a feed cassette 110. The feed section further includes a feed roller 113 that is half-moon shaped for feeding the recording media 112 sheet by sheet from the form loading section 111. A separation pad 114 made of a high friction material is provided countering the feed roller 113 for separating the sheets. The separation pad 114 is energized toward the feed roller 113.

The image formation apparatus further includes a conveyance section for conveying the form 112 that is fed from the feed section, and the conveyance is carried out below the recording head 107. The conveyance section includes a conveyance belt 121 for electro-statically attracting and conveying the form 112, a counter roller 122 for sandwiching and conveying the form 112 with the conveyance belt 121, so that the form 112 is carried through a guide 115 from the feed section, a conveyance guide 123 for changing the conveyance direction of the form 112 that is nearly perpendicularly traveling to a nearly horizontal direction so that the conveyance direction follows the conveyance belt 121, a pressing roller 125A that is energized by a pressing member 124 toward the conveyance belt 121, a tip pressing roller 125B, and an electrification roller 126 for charging (electrifying) the surface of the conveyance belt 121.

Here, the conveyance belt 121 is an endless belt, and is wound around a conveyance roller 127 and a tension roller 128. The conveyance belt 121 is driven in a belt conveyance direction (the direction of vertical scanning) by the conveyance roller 127 that is rotated by a vertical scanning motor 131 through a timing belt 132 and a timing roller 133. Further, a guide member 129 is arranged on the rear side of the conveyance belt 121 corresponding to the image formation area of the recording head 107.

The electrification roller 126 contacts the surface of the conveyance belt 121, and follows the rotational movement of the conveyance belt 121. Each of the ends of the axle of the electrification roller 126 is pressed with force of 2.5 N.

Further, the image formation apparatus includes a delivery section for delivering the form 112 that carries an image recorded by the recording head 107. The delivery section includes a separation section for separating the form 112 from the conveyance belt 121, a delivery roller 152, a delivery roller 153, and a delivery tray 154 that stacks the forms 112 that are delivered.

Further, the image formation apparatus includes a double-side feeding unit 155 on the rear side, which unit 115 can be attachable and detachable. The double-side feeding unit 155 takes in the form 112 returned by rotation in an opposite direction of the conveyance belt 121, reverses the form 112, and feeds the reversed form 112 between the counter roller 122 and the conveyance belt 121.

Further, a maintenance recovery mechanism 156 for maintaining and restoring conditions of the nozzles of the recording head 107 is arranged in a non-printing area on one side in the scanning direction of the carriage 103 as shown in FIG. 14.

The maintenance recovery mechanism 156 includes caps 157 for capping the nozzles of the recording head 107, a wiper blade 158 for wiping the nozzles, and a waste discharging receptacle 159 for receiving drops that are discharged in order to discharge thickened recording liquid that does not contribute to recording.

According to the image formation apparatus constituted as described above, the form 112 is fed sheet by sheet from the feed section, travels upward almost vertically, is guided by the guide 115, is inserted between the conveyance belt 121 and the counter roller 122, and is further conveyed. Then, the tip of the form 112 is guided by the conveyance guide 123, is pushed to the conveyance belt 121 by the tip pressurization roller 125, and is conveyed almost horizontally.

At this time, the control circuit (not illustrated) causes an AC bias supply unit (not illustrated) to apply an AC voltage to the electrification roller 126, and an electrification voltage pattern having a predetermined width is generated on the conveyance belt 121 in the vertical scanning direction. That is, positively charged areas and negatively charged areas are alternately arranged in the rotational direction of the conveyance belt 121. Then, if the form 112 is conveyed on the conveyance belt 121 that is charged as described above, the form 112 is electro-statically attracted by the conveyance belt 121, and is conveyed by the rotational movement of the conveyance belt 121 in the direction of vertical scanning.

Then, the carriage 103 is moved in the horizontal scanning directions to and fro, while the recording head 107 is driven according to an image signal; an ink drop is discharged onto the form 112 that stays so that a line is recorded; then, the form 112 is vertically conveyed by a predetermined amount so that the following line is recorded. At a recording ending signal or a signal that indicates that the form 112 has arrived at the ending edge of the recording area, the recording operation is ended and the form 112 is delivered to the delivery tray 154.

In the case of double-side printing, the conveyance belt 121 is rotated in the inverse direction when recording the first surface is completed; the form 112 is sent to the double-side feeding unit 155; the form 112 is reversed; and the form 112 is fed between the counter roller 122 and the conveyance belt 121 again. In this way, recording the second surface of the form 112 is carried out. Then, the timing control is carried out, recording the second surface is carried out similar to recording the first surface, and the form 112 is delivered to the delivery tray 154.

In addition, while no printing (recording) is performed, i.e., in a stand-by mode, the carriage 103 is moved to the maintenance recovery mechanism 155, and the nozzles of the recording head 107 are capped with the caps 157 so that the nozzles keep wetness, preventing poor discharging due to ink dryness from occurring. Further, while the recording head 107 is capped with the caps 157, "nozzle suction" or "head suction" is carried out wherein recording liquid is suctioned from the nozzles such that thickened recording liquid and air bubbles are discharged. Further, in order to remove ink that is adhered to the nozzles of the recording head 107, the nozzles are wiped with the wiper blade 158. Further, waste discharging is carried out for discharging ink that is not related to recording before and during recording so that the discharging performance of the recording head 107 is stabilized and maintained.

Figure 15:
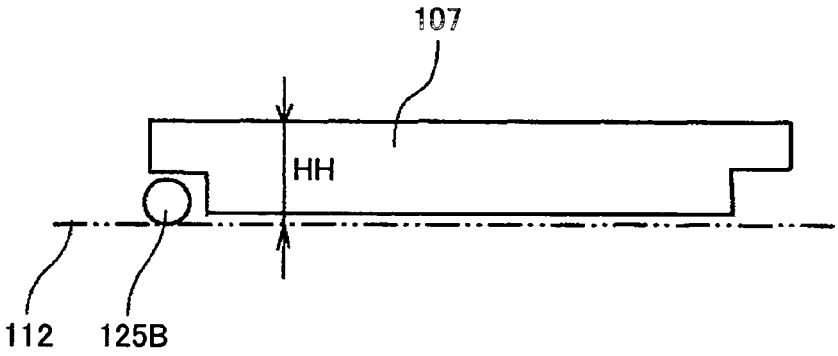
FIG. 15 is a schematic diagram showing an arrangement of a recording head and a tip pressing roller.
Figure 16:
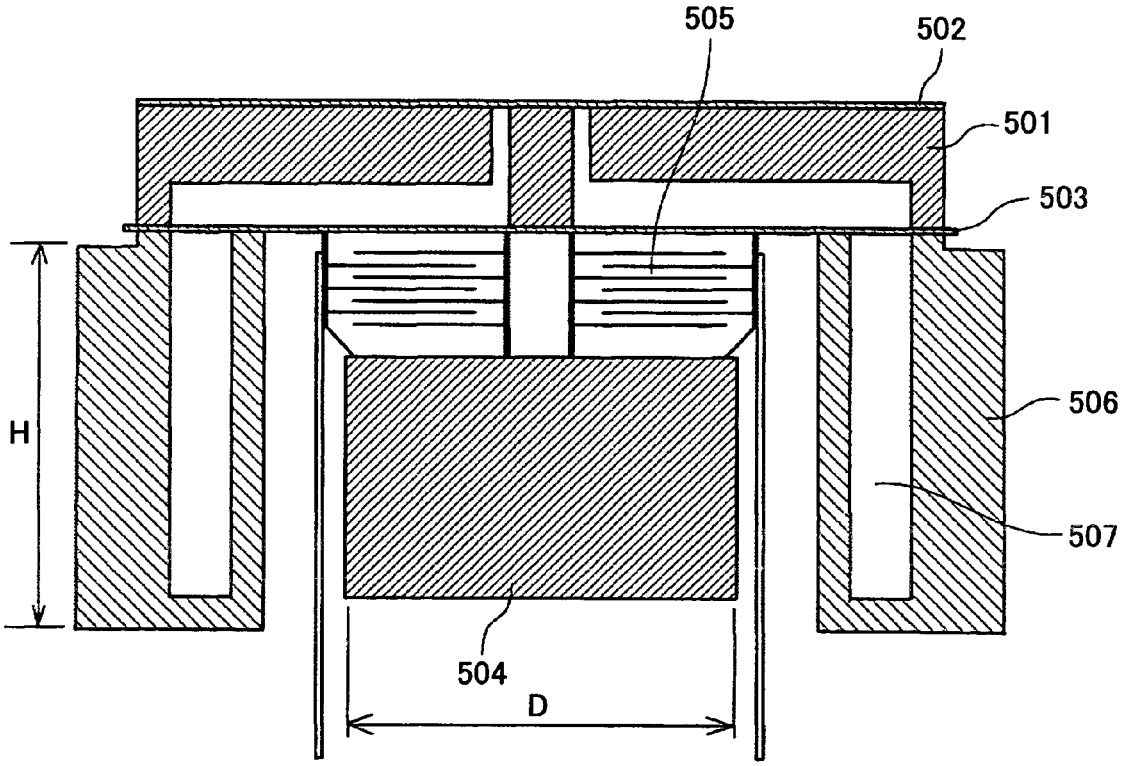
FIG. 16 is a cross-sectional diagram of a conventional liquid discharging head.
Figure 17:
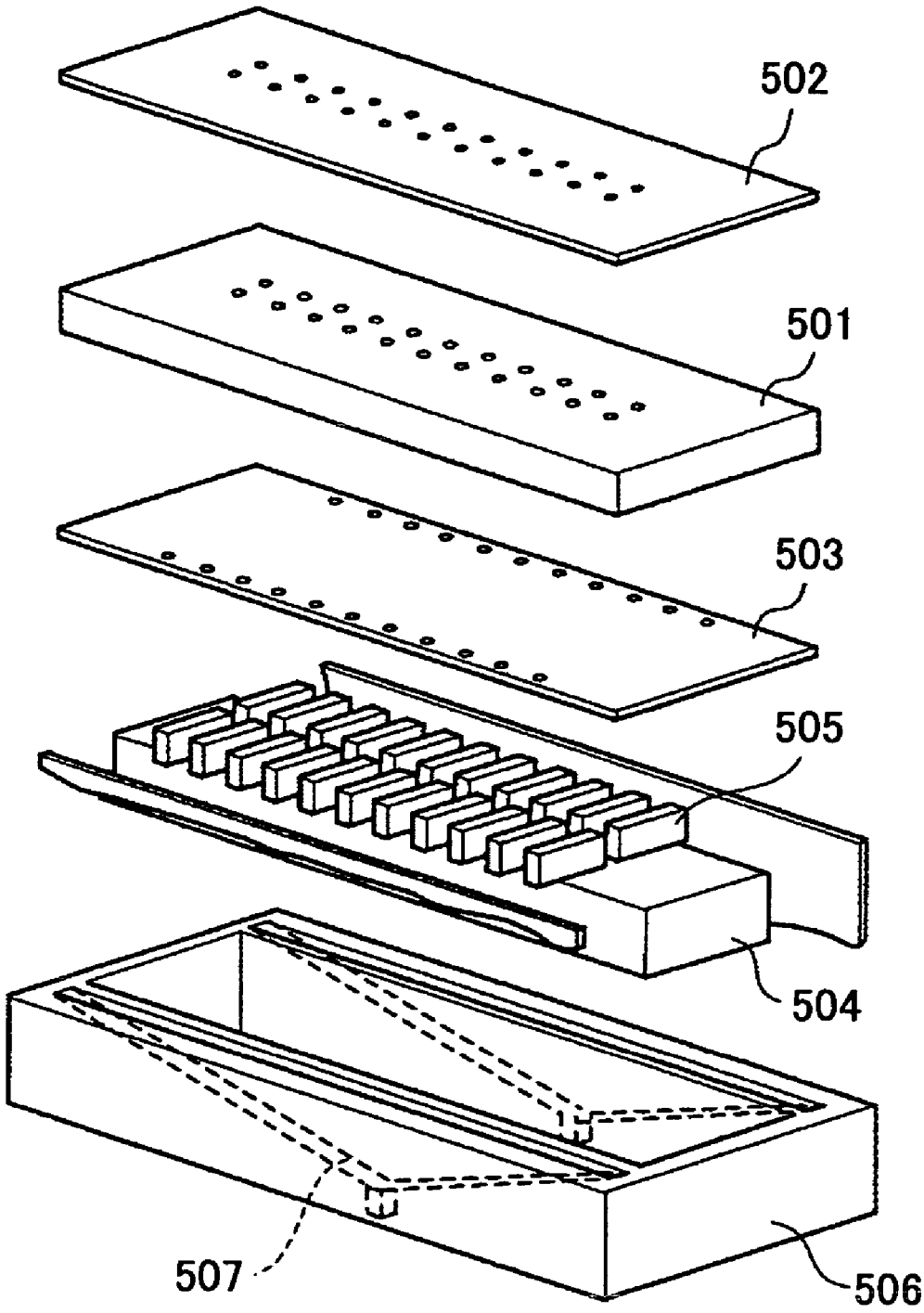
FIG. 17 is an exploded perspective diagram of the conventional liquid discharging head.

As described, since the image formation apparatus includes the recording head constituted by the liquid discharging head of the embodiments of the present invention, miniaturization and cost reduction are attained. Further, even if miniaturization is attained, since a height H of the recording head 107 is available as shown in FIG. 15, the tip pressurization roller 125B can be arranged close to the recording head 107 so that the form 112 is prevented from rubbing the recording head 107.

Although the embodiments are described using examples wherein the present invention is applied to the image formation apparatus structured as a printer, application of the present invention is not limited to this, but the present invention can be applied to image formation apparatuses such as a printer, a facsimile apparatus, a copier, a multi-function machine. Further, the present invention is applicable to an image formation apparatus using recording liquid, fixing processing liquid, etc. other than ink.

Further, the present invention is not limited to these embodiments, but variations and modifications may be made without departing from the scope of the present invention.

The present application is based on Japanese Priority Application No. 2005-266162 filed on Sep. 14, 2005 with the Japanese Patent Office, the entire contents of which are hereby incorporated by reference.

What is claimed is:

1. A liquid discharging head, comprising:

nozzles for discharging a drop of recording liquid;

corresponding liquid chambers having a free passage to the nozzles;

corresponding driving elements for pressurizing the recording liquid contained in the liquid chambers; and a base member configured to have a first surface and a second surface that is another surface of the base member opposite to the first surface, the base member being configured to be joined to the driving elements on at least a portion of the first surface of the base member;

wherein a total area of the first surface of the base member is less than a total area of the second surface which is opposite to the first surface of the base member.

2. The liquid discharging head as claimed in claim 1, wherein each of the driving elements is a laminated type piezoelectric device.

3. The liquid discharging head as claimed in claim 1, wherein the base member is shaped like a stair step in a plane that perpendicularly intersects directions of a nozzle sequence.

4. The liquid discharging head as claimed in claim 1, wherein the base member has a slanted cutoff starting from the first surface in a plane that perpendicularly intersects directions of a nozzle sequence.

5. The liquid discharging head as claimed in claim 1, wherein the base member is shaped like a cross section of a rail in a plane that perpendicularly intersects directions of a nozzle sequence.

6. The liquid discharging head as claimed in claim 1, wherein the area of the first surface is less than an area of a cross-sectional contour of the driving element, the cross-sectional contour being parallel to the first surface.

7. The liquid discharging head as claimed in claim 2, wherein a flexible printed circuit board is directly and electrically connected to an edge electrode of the piezoelectric device.

8. The liquid discharging head as claimed in claim 2, wherein at least one edge surface of the base member, the edge surface being parallel to a direction of the nozzle sequence and parallel to a direction of ink drop discharging, and at least an edge surface of the piezoelectric device are in the same plane.

9. The liquid discharging head as claimed in claim 1, wherein a "side shooting" method is used wherein a direction of discharging the drop is different from a direction of a flow of the recording liquid in the liquid chamber.

10. An image formation apparatus, comprising:

the liquid discharging head as claimed in claim 1.

11. The liquid discharging head of claim 1, wherein a cross-section of the base member corresponds to a "T" shape.

12. The liquid discharging head of claim 1, wherein a width of the first surface in a longitudinal direction of the liquid discharging head is less than a width of said second surface of the base member in the longitudinal direction.

13. The liquid discharging head of claim 1, wherein the driving elements are attached to the first surface such that a first portion of a surface of the driving elements is directly attached to the first surface and a second portion of the surface of the driving elements is not attached to the first surface.

14. The liquid discharging head of claim 1, wherein a portion of the base member including the first surface has recessed portions, and edges of the first surface are recessed inwards from edges of the driving elements.

15. The liquid discharging head of claim 1, wherein a width of the driving elements is greater than a width of the first surface of the base member, and the width of the driving elements is less than a width of said second surface of the base member.

* * * * *